United States Patent [19]

Ludwig et al.

[11] 4,326,353

[45] Apr. 27, 1982

[54] MAGAZINE CATCH RELEASE FOR A HAND FIREARM

[75] Inventors: Walter Ludwig, Ulm, Fed. Rep. of Germany; Franziska Schmid, deceased, late of Langenau, Fed. Rep. of Germany, by Hans Schmid, heir

[73] Assignee: Carl Walther GmbH, Ulm, Fed. Rep. of Germany

[21] Appl. No.: 119,407

[22] Filed: Feb. 7, 1980

[30] Foreign Application Priority Data

Feb. 15, 1979 [DE] Fed. Rep. of Germany ..... 2905770

[51] Int. Cl.[3] ..... F41C 25/06

[52] U.S. Cl. ..... 42/7

[58] Field of Search ..... 42/6, 7

[56] References Cited

U.S. PATENT DOCUMENTS

| | | | |
|---|---|---|---|
| 804,985 | 11/1905 | Searle | 42/7 |
| 3,715,826 | 2/1973 | Seifried | 42/6 |
| 4,236,337 | 12/1980 | Beretta | 42/7 |
| 4,237,638 | 12/1980 | Trexler | 42/6 |

*Primary Examiner*—Charles T. Jordan

*Attorney, Agent, or Firm*—Edmund M. Jaskiewicz

[57] ABSTRACT

A hand firearm, such as an automatic pistol, has a butt or handle in which a magazine is mounted. The magazine is retained in position by a locking member which can be actuated from either side of the pistol by the hand of the user holding the firearm. The locking member is a spring-loaded lever which has a projection received in an opening in the wall of the magazine to lock the magazine in position. An actuating member extends on both sides of the firearm and is operatively connected with the locking lever so that actuation of the actuating element will pivot the lever to unlock the magazine.

8 Claims, 8 Drawing Figures

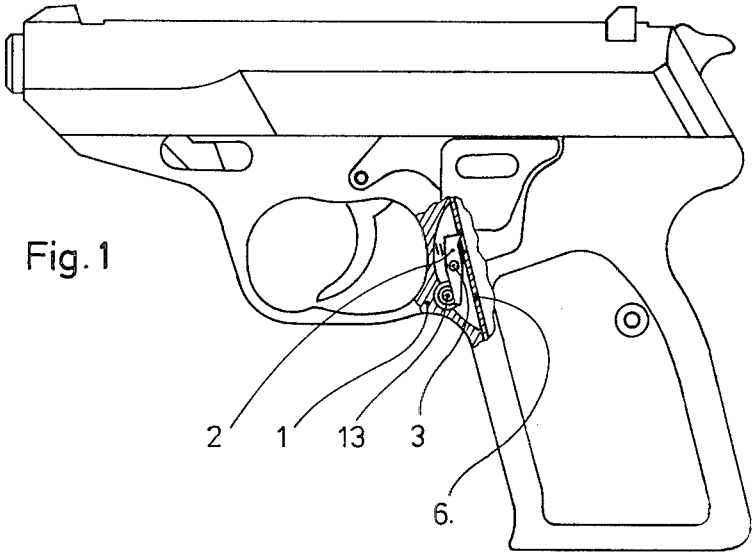
Fig. 1
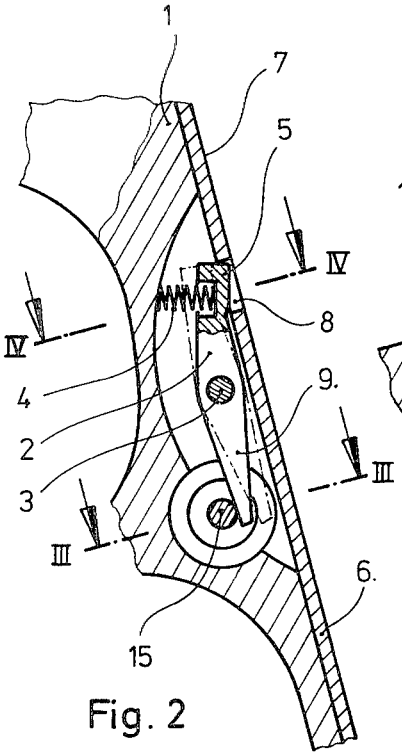
Fig. 2
Fig. 3
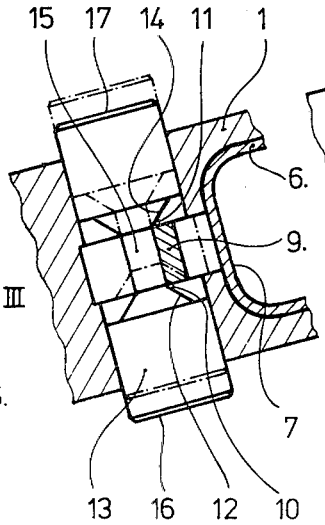
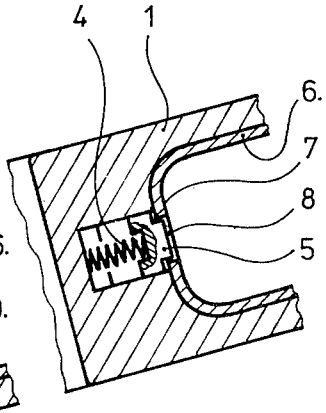
Fig. 4

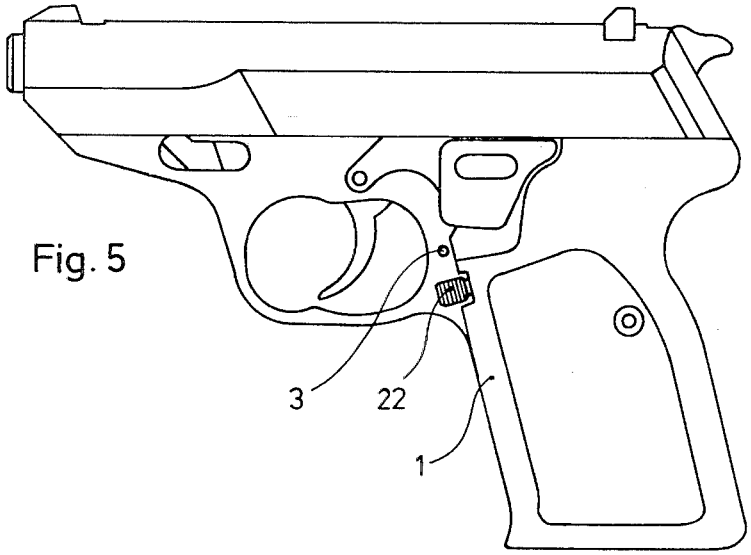
Fig. 5
Fig. 6
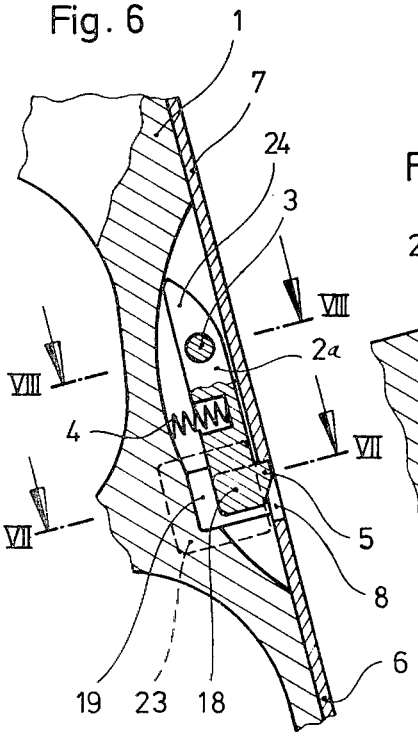
Fig. 7
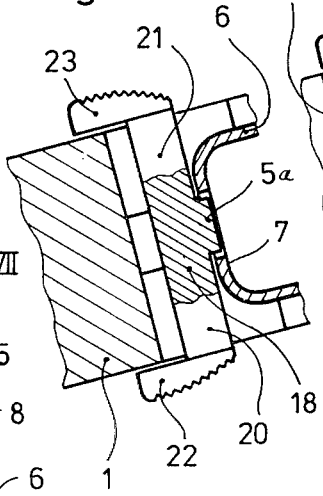
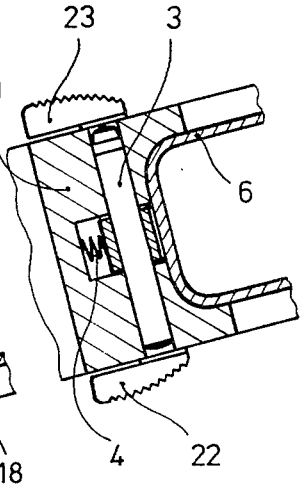
Fig. 8

MAGAZINE CATCH RELEASE FOR A HAND FIREARM

The present invention relates to a hand firearm having a magazine in the butt thereof, more particularly, to a structure actuable from either side of the firearm by the hand of the user holding the firearm to unlock and release the magazine.

Hand firearms, particularly self-loading or automatic pistols, are generally constructed so that a magazine can be inserted and locked into the handle or butt of the firearm. The mechanism for locking the magazine in the stock is usually operable by the hand holding the pistol in order to unlock the magazine. A specific structure for locking the magazine in the butt is disclosed in DE-OS 2 618 074 wherein the operating element for the magazine locking device is located on the outer side of the pistol butt approximately in the center of the side surface of the pistol grip. This actuating element comprises a slider which can be moved downwardly by the thumb of the hand holding the pistol. Downward movement of the slider removes a projection from a recess which is located in one of the two side walls of the magazine. The magazine is thus unlocked and can drop down out of the magazine shaft.

A disadvantage of this locking structure is that the actuating element and the magazine locking device must be located on the other side of the hand grip when the firearm is to be used by a left-handed person. Since two forms of the same firearm must be constructed, for right-handed and left-handed persons, it can be seen that the costs and expenses of the firearm are significantly increased.

It is therefore the principal object of the present invention to provide a novel and improved magazine catch release device which can be actuated from either side of the firearm.

It is another object of the present invention to provide a magazine catch release for a hand firearm which is operable from either side of the handle of the firearm by the hand of the user of the firearm regardless of whether the person is right or left handed.

According to one aspect of the present invention a device for retaining a magazine in a hand firearm may comprise means on the firearm for releaseably locking a magazine inserted within the butt of the firearm. On each side of the firearm there is actuating means which are operatively connected to the locking means. The actuating means are actuable by the hand of the user holding the firearm to unlock the magazine.

Other objects and advantages of the present invention will be apparent upon reference to the accompanying description when taken in conjunction with the following drawings, which are exemplary, wherein;

FIG. 1 is a side elevational view of a hand firearm incorporating the present invention with a portion thereof cut away;

FIG. 2 is an enlarged view in section of the cut-away portion of the firearm of FIG. 1;

FIG. 3 is a sectional view taken along the line III—III of FIG. 2;

FIG. 4 is a sectional view taken along the line IV—IV of FIG. 2;

FIG. 5 is a side elevational view of a firearm incorporating a modification of the present invention with a portion thereof cut away;

FIG. 6 is an enlarged side view in section of the cut-away portion of the firearm of FIG. 5 incorporating the modified magazine locking device of the present invention;

FIG. 7 is a sectional view taken along the line VII—VII of FIG. 6; and

FIG. 8 is a sectional view taken along the line VIII—VIII of FIG. 6.

Proceeding next to the drawings wherein like reference symbols indicate the same parts throughout the various views a specific embodiment and modifications of the present invention will be described in detail.

As may be seen in FIG. 1, a hand firearm such as an automatic or self-loading pistol, has a handle or butt 1 in which is mounted a magazine release catch or retaining lever 2 to pivot about an axis 3 positioned transversely of the direction of fire of the firearm. The magazine retainer 2 comprises a two-armed lever one arm of which is acted upon by a spring 4 and is provided with a projection 5. A magazine 6 is pushed or inserted into the magazine shaft within the butt 1 and the magazine 6 has a front wall 7 in which is an opening or slot 8. The magazine 6 is held in position within the stock and locked in this position by means of the projection 5 of the magazine retainer 2 engaging the recess 8 of the end wall 7 of the magazine 6, as shown in FIG. 2.

A second arm 9 of the magazine retainer has respective lateral control edges 10 and 11 which may be seen in FIG. 3. The control edge 10 is engageable by a conical surface 12 formed on an actuating element which consists of a bolt 13 mounted in the stock butt 1 for axial displacement transversely of the direction of fire of the firearm. A second conical surface 14 is formed on the bolt 13 so as to be opposite the conical surface 12 and is engageable by the control edge 11 of the lever arm 9.

The conical surfaces 12 and 14 are positioned in mirror-image relationship to each other and are formed in the central portion of the bolt 13. The conical surfaces 12 and 14 are connected by a smaller diameter central portion 15 of the bolt having a length corresponding approximately to the width of the arm 9.

The bolt 13 has two free outer ends 16 and 17 which protrude beyond the lateral or side surfaces of the butt 1 and each of the ends 16 and 17 forms a push button which can be actuated inwardly of the stock 1. The bolt 13 is constructed integrally with the ends 16,17, the conical surfaces 12,14, and the center connecting member 15 of the bolt.

When the magazine 16 is pushed into the butt 1 of the pistol, the projection 5 of the magazine retainer 2 will be urged by the spring 4 into the opening 8 of the magazine end wall 7 to lock the magazine 6 within the stock 1. In order to remove the magazine 6 from the stock 1, the user of the firearm, if right-handed, presses with the thumb of the right hand on the left end 16 of the bolt 13. The bolt 13 is thus moved axially inwardly so that the conical surface 12 engages the control edge 10 of the arm 9 and cams the magazine retainer 2 so that the retainer 2 pivots against the force of the spring 4 in a counterclockwise direction about the axis 3. This pivoting movement of the retainer 2 releases the projection 5 from the recess 8 of the magazine end wall 7 and the magazine 6 will be released to drop out of the butt 1. If the user of the pistol is left-handed, he presses with the thumb of the left hand on the right hand end 17 of the bolt 13 to unlock the magazine 6 in the same manner as described above.

The dotted lines in FIGS. 2 and 3 illustrate the unlocked positions of the magazine retainer 2 and the bolt 13.

A preferred embodiment of the invention is illustrated in FIGS. 5–8 wherein a magazine release catch 2*a* is mounted to pivot about an axis 3*a* and is constructed in the form of a lever with a projection 5*a* at its downwardly directed end, as seen in FIG. 6. The projection 5*a* engages in the opening 8 formed in the forward end wall 7 of the magazine 6. The magazine release catch 2*a* is held in this locked engagement with its projection 5*a* received within the opening 8 by a spring 4*a*.

On the downwardly directed end of the magazine release catch 2*a* spaced from the pivot axis 3*a* there is a transversely extending web 18 which extends transversely to the direction of the line of fire of the pistol. The web 18 is received within a chamber or recess 19 formed in the butt 1 immediately behind the trigger guard and similarly extending transversely to the direction of fire of the pistol. The web 18 has two outer ends 20 and 21 which extend outwardly beyond the lateral or side faces of the butt 1 and operating plates 22,23 are attached respectively to the web ends 20 and 21. The plates 22 and 23 are each provided with a knurled surface or with a plurality of close vertically extending grooves on its outer surface as shown in the drawings to facilitate manipulation of the magazine release catch with the fingers.

The upper end of the magazine release catch 2*a* which is above the pivot axis 3*a* as seen in FIG. 6 engages a surface of the butt 1 when in the locked position as also shown in FIG. 6 to function as a stop for the magazine release catch.

The chamber of recess 19 in the butt 1 is made sufficiently large so that the magazine release catch 2*a* with its projection 5*a* can pivot out of and become released from the opening 8 in the magazine.

In order to unlock and release the magazine, the user of the pistol, if he is right-handed, presses the operating plate 22 forwardly with the thumb of his right hand until projection 5*a* becomes disengaged from the opening 8 of the end wall 7 and the magazine 6 is then free to fall out downwardly from the magazine shaft. If the user of the pistol is left-handed, the magazine release catch 2*a* is pivoted forwardly by applying pressure on the operating plate 23 with the thumb of the left hand and the magazine is unlocked in the same manner.

The actuating element in the preferred embodiment thus comprises a web which is rigidly attached to the magazine release catch and extends transversely of the direction of firing in a chamber formed in the butt. This web is spaced from the pivot axis of the magazine release catch and both ends of the web extend outwardly on both sides of the butt. Operating plates which are readily accessible to be easily manipulated by the thumb of the user are provided on the extending ends of the web. The web is located on the magazine release catch below the pivot axis and is pivotable forwardly in the direction of line of fire to release the magazine and thereby enable the pistol to remain in the direction of fire when the magazine is released. The magazine release catch is positioned centrally between the two side faces of the butt in order to pivot about an axis disposed at right angles to the direction of fire. The chamber or recess into which the projection of the magazine release catch is engages is located in a front end wall of the magazine.

Thus it can be seen that the present invention provides an improved structure for retaining or holding the magazine within the butt of the pistol wherein the structure comprises a spring-loaded catch lever pivotally mounted in the butt and having a projection which engages an opening in a wall of the magazine.

As a result, the magazine release catch of the present invention enables the same pistol to be used by both right and left-handed users. The same components can always be used to manufacture the pistol thus simplifying and reducing the costs of production, inventory and availability of spare parts. The actuating element for the magazine release catch is operated simply and identically by the right or left hand with a minimum of effort so that it is not necessary to move or deviate the pistol from the firing direction.

It will be understood that this invention is susceptible to modifications in order to adapt it to different usages and conditions, and accordingly, it is desired to comprehend such modifications within this invention as may fall within the scope of the appended claims.

What is claimed is:

1. A device for retaining a magazine in a hand firearm comprising means on the firearm for releaseably locking a magazine within a butt of the firearm, and actuating means on both sides of the firearm and operatively connected to said locking means, said actuating means being actuable from either one of both sides of the firearm by the hand of the user holding the firearm whereby the user can unlock the magazine with either hand holding the firearm.

2. A device as claimed in claim 1 wherein said locking means comprises a spring-loaded lever pivotally mounted in said butt and having a projection thereon, there being an opening in a wall of the magazine to receive said projection, said lever has first and second arms, said first arm being spring-loaded and carrying said projection thereon and said second arm being operatively connected to said actuating means, said actuating means comprises a web extending transversely of the line of fire of the firearm and connected to said lever, said web being spaced from the pivotal mounting of said lever and having two ends each of which projects from a side of the firearm, and an actuating plate on each side of said web.

3. A device as claimed in claim 2 wherein said actuating means comprises an axially displaceable bolt in said butt and extending transversely of the line of fire of the firearm, said bolt having two ends each of which projects outwardly of a side of the firearm, said bolt having opposed conical surfaces engageable with control edges on said second arm of said lever such that upon axial displacement of said bolt one of said conical surfaces will engage a said control edge to pivot said lever and unlock said projection from the opening in said magazine.

4. A device as claimed in claim 1 wherein said locking means comprises a spring-loaded lever pivotally mounted in said butt and having a projection thereon, there being an opening in a wall of the magazine to receive said projection, said actuating means comprises a web extending transversely of the line of fire of the firearm and connected to said lever, said web being spaced from the pivotal mounting of said lever and having two ends each of which projects from a side of the firearm, and an actuating plate on each end of said web.

5. A device as claimed in claim 4 wherein said web is disposed in a chamber in the butt of the firearm.

6. A device as claimed in claim 4 wherein said web is positioned on said lever below the pivot mount thereof such that pivoting of the lever toward the muzzle of the firearm will unlock the magazine.

7. A device as claimed in claim 4 wherein said lever is pivotally mounted between the side faces of the butt to pivot about an axis extending transversely to the line of fire of the firearm, the magazine having a front wall with said opening therein to receive said locking means projection.

8. A device as claimed in claim 7 wherein said lever has a first arm which is spring-loaded and said web and said projection being attached to said first arm.

* * * * *